United States Patent [19]

Woodhull, Jr.

[11] 4,429,738

[45] Feb. 7, 1984

[54] HEAT EXCHANGER CONSTRUCTION

[75] Inventor: Ivan D. Woodhull, Jr., Flat Rock, Mich.

[73] Assignee: Karmazin Products Corporation, Wyandotte, Mich.

[21] Appl. No.: 291,470

[22] Filed: Aug. 10, 1981

Related U.S. Application Data

[63] Continuation of Ser. No. 6,678, Jan. 26, 1979, abandoned.

[51] Int. Cl.[3] ..... F28D 1/04

[52] U.S. Cl. ..... 165/151; 29/157.3 B; 29/157.3 C

[58] Field of Search ..... 165/151-153, 29/157.3 A, 157.3 B, 157.3 C, 157.3 D; 228/114, 175

[56] References Cited

U.S. PATENT DOCUMENTS

| | | | |
|---|---|---|---|
| 1,940,963 | 12/1933 | McIntyre . | |
| 2,028,456 | 1/1936 | Karmazin | 29/157.3 D |
| 2,064,036 | 12/1936 | Sandberg . | |
| 2,064,141 | 12/1936 | Askin | 29/157.3 D |
| 2,133,990 | 10/1938 | Karmazin | 165/151 X |
| 2,134,665 | 10/1938 | Karmazin | 165/174 X |
| 2,228,549 | 1/1941 | Young | 165/151 |
| 2,232,562 | 2/1941 | Sandberg . | |
| 3,601,878 | 8/1971 | Karmazin . | |
| 3,972,111 | 8/1976 | Dash | 228/175 |
| 4,072,787 | 2/1978 | Ricks | 228/175 |

*Primary Examiner*—William R. Cline
*Assistant Examiner*—Theophil W. Streule, Jr.
*Attorney, Agent, or Firm*—Harness, Dickey & Pierce

[57] ABSTRACT

There is disclosed herein a heat exchanger of the multiple pass counterflow fin and tube type having an improved return bend construction. The return bend construction comprises a base member having a plurality of tapered tubular projections extending outward from one side thereof which define openings extending therethrough. These projections telescopically engage ends of the fluid conducting conduits or tubes. A cover member is provided which is secured to the base member and has a plurality of localized embossments provided thereon which are arranged so as to provide a passageway placing two or more openings in the base plate in mutual fluid communication. The base member also operates as part of a surrounding frame for the heat exchanger and may include mounting points for securing the heat exchanger in the equipment with which it is to be utilized.

6 Claims, 12 Drawing Figures

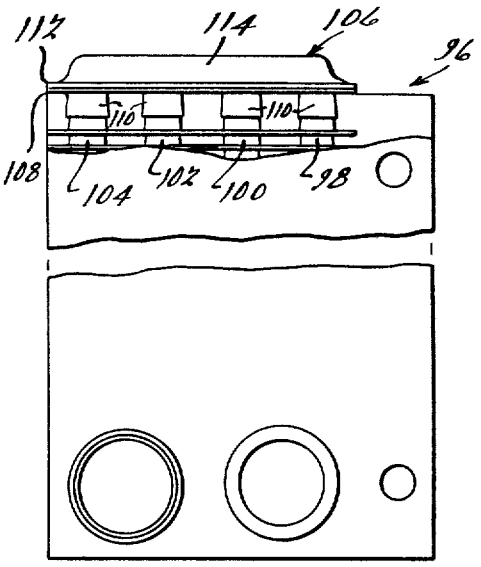
Fig. 4.
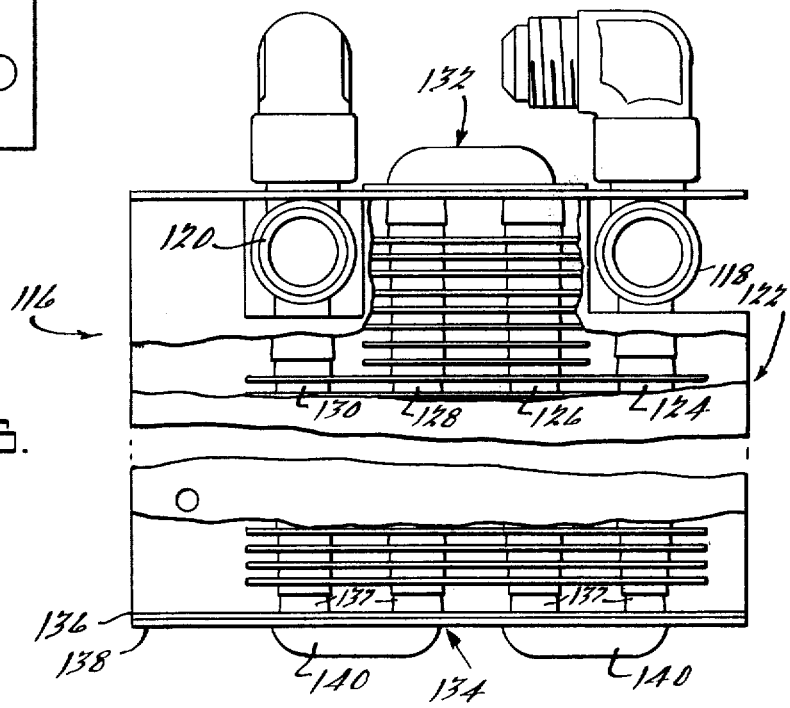
Fig. 5.
Fig. 6.
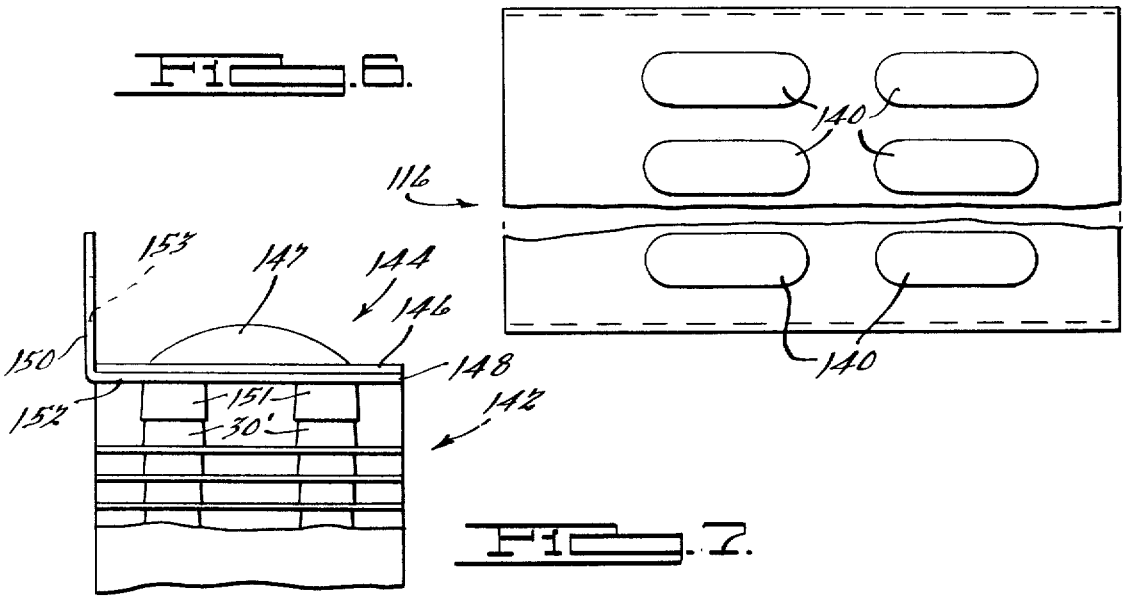
Fig. 7.

HEAT EXCHANGER CONSTRUCTION

This is a continuation of application Ser. No. 6,678, filed Jan. 26, 1979 now abandoned.

BACKGROUND AND SUMMARY OF THE INVENTION

The present invention relates generally to heat exchangers and more specifically to a return bend asembly for use in a multiple pass counterflow heat exchanger of the fin and tube type construction.

Heat exchangers of the fin and tube type construction are employed in a wide variety of applications in which it is desired to transfer heat between two fluids such as for example between a liquid flowing through the tubes and a gas directed across the fins thereof. In order to insure sufficient heat dissipation or transfer to the gaseous fluid flowing across the fins, it is often desirable to cause the fluid to make several passes through the finned tubes rather than a single pass. Such techniques may be employed for various reasons, one being to enable the heat exchanger to be contained within a relatively small envelope or overall size while still providing a sufficient heat dissipation for the intended use. These heat exchangers are generally referred to as multiple pass counterflow types.

In a typical construction of a multiple pass counterflow fin and tube heat exchanger a plurality of fluid conducting conduits are provided generally arranged in multiple rows, each conduit being surrounded by a plurality of substantially parallel spaced fins along its length. An inlet header is connected in fluid communication to one end of each of a series of fluid conduits defining a first row and an outlet header similarly connected to one end of another row of fluid conduits. Assuming for example the heat exchanger is a two pass counterflow type having only two rows of fluid conduits, the other ends of the first and second row must be interconnected so as to conduct the fluid from the inlet header to the outlet header. One manner which has been employed for interconnecting these fluid conduits is by providing a separate return bend assembly for each pair of conduits. Such a construction is disclosed in U.S. Pat. No. 3,420,692. While this type of return bend construction is effective in interconnecting the separate conduits, it is relatively expensive to manufacture and assemble requiring each return bend assembly to be separately manufactured and assembled to the heat exchanger core. Further, in order to protect the return bend members as well as to provide a frame for the heat exchanger such as to provide attachment points for securing the heat exchanger to equipment with which it is to be used, a separate frame member must be fabricated and assembled thereto.

Accordingly, the present invention provides an improved return bend construction which provides a single return bend assembly which may be assembled as a single unit to one end of the heat exchanger core so as to place each fluid conduit in one or more rows in direct fluid communication with the corresponding fluid conduit in an adjacent row or rows. The return bend assembly of the present invention requires the assembly of only two separately fabricated pieces which are operative to interconnect all of the fluid conduits provided at one end of the heat exchanger core in any desired configuration. Thus, substantial cost savings may be realized both in the manufacturing of the return bend assembly as well as in the assembling of the complete heat exchanger. Further, the base member of the return bend assembly of the present invention may be designed to function as a portion of the heat exchanger frame as well as include mounting means for securing the heat exchanger to the equipment with which it is to be used. Also, the return bend assembly of the present invention provides a substantial mutually engaging surface area surrounding each of the passageways provided between the two assembled pieces which greatly reduces the possibility of leaks being encountered during the life of the heat exchanger.

Additionally, the return bend construction of the present invention is well suited for a variety of heat exhanger designs including those in which each adjacent row of fluid conduits conducts fluid in an opposite direction as well as those in which several adjacent rows of fluid conduits conduct fluid in the same direction and groups of rows are interconnected to conduct fluid in opposite directions.

Additional advantages and features of the present invention will become apparent from the subsequent description and the appended claims taken in conjunction with the accompanying drawings.

BRIEF DESCRIPTION OF THE DRAWINGS

FIG. 4 is a side elevational view of another embodiment of a heat exchanger in accordance with the present invention with portions thereof being broken away;

FIG. 5 is a side elevational view similar to that of FIGS. 1 and 4 but showing yet another embodiment of the present invention with portions thereof broken away;

FIG. 6 is a bottom plan view of the heat exchanger of FIG. 5;

FIG. 7 is a fragmentary view of a heat exchanger in accordance with the present invention in which the return bend assembly includes an integral mounting flange;

DESCRIPTION OF THE PREFERRED EMBODIMENTS

Figure 1:
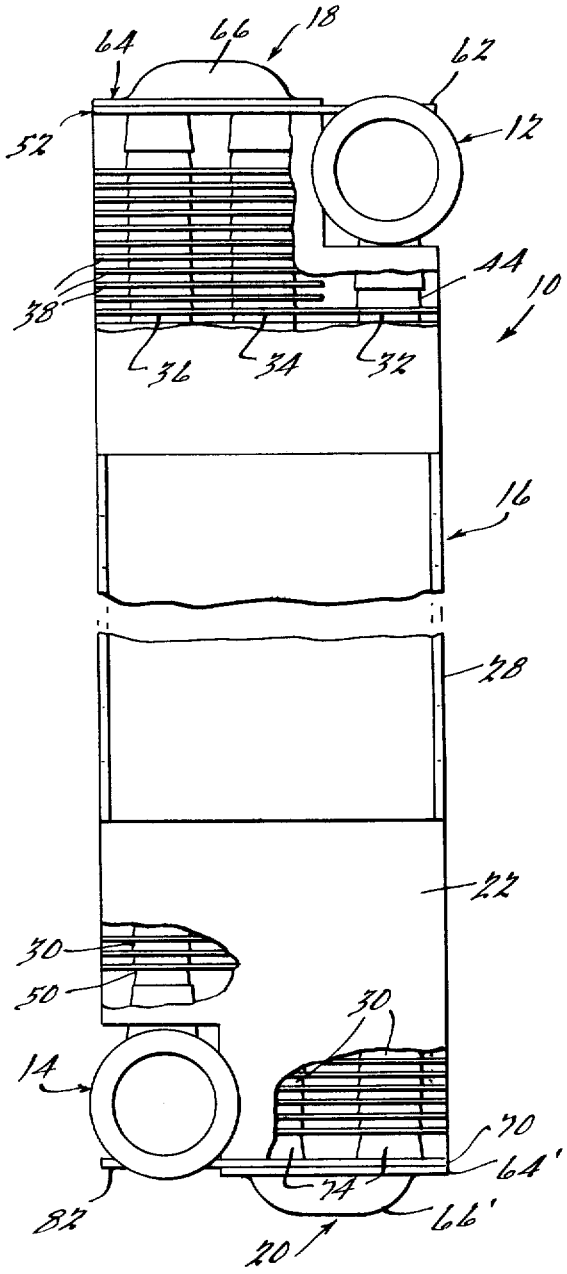
FIG. 1 is a side elevational view of a heat exchanger in accordance with the present invention having portions thereof broken away.
Figure 2:
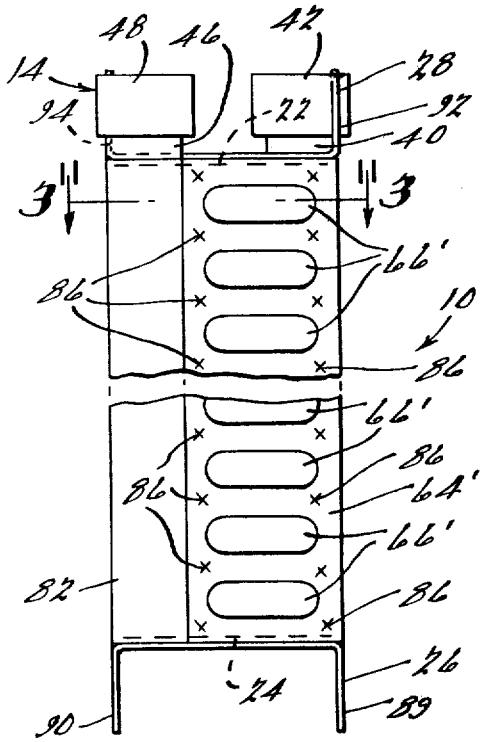
FIG. 2 is a bottom plan view of the heat exchanger of FIG. 1.

Referring now to the drawings and in particular to FIGS. 1 through 3A, there is shown a heat exchanger 10 in accordance with the present invention comprising an inlet header 12, an outlet header 14, a core assembly 16, an upper return bend assembly 18, a lower return bend assembly 20, a surrounding framework including elongated side members 22 and 24, and upper and lower return bend assemblies 18 and 20 and mounting channel brackets 26 and 28.

Core assembly 16 is of the fin and tube type having a plurality of fluid conducting conduits 30 arranged in multiple rows 32, 34, and 36, each row having any desired number of such fluid conduits 30. A plurality of heat radiating fins 38 are provided being arranged in surrounding spaced substantially parallel relationship to conduit members 30. Preferably, core 16 will be fabricated from a plurality of sheets each having a plurality of tapered tubular projections defining openings extending therethrough which sheets are arranged in a stacked nested relationship. Such a construction is disclosed in U.S. Pat. No. 3,601,878, the disclosure of which is hereby incorporated by reference.

Inlet header 12 comprises a generally cylindrically shaped elongated tubular member 40 having a female nipple 42 provided at one end to which a fluid supply line may be connected. Inlet header 12 is connected in fluid communication with one end 44 of each of the fluid conducting conduits 30 disposed in row 32 of heat exchanger core 16.

Outlet header 14 is substantially identical to inlet header 12 also comprising a generally cylindrically shaped elongated tubular member 46 having a female nipple 48 provided on one end thereof to which a fluid supply line may be connected. Also, outlet header 14 is connected in fluid communication with one end 50 of each of the fluid conduit members 30 disposed in row 36 of heat exchanger core 16.

As shown, rows 32 and 36 of fluid conducting members 30 are slightly shorter than row 34 so as to enable inlet and outlet headers 12 and 14 to be accommodated within the generally rectangular perimeter of heat exchanger core 16.

Figure 3:
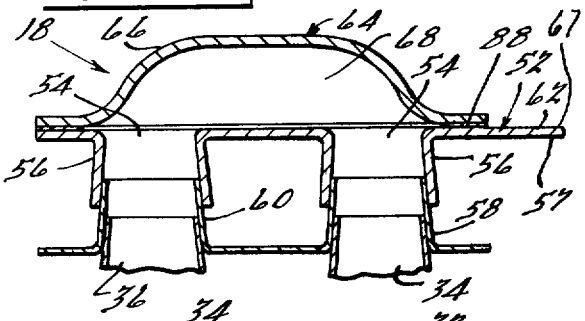
FIG. 3 is a fragmentary view of the upper end of the heat exchanger of FIG. 1 shown in section, the section being taken along line 3—3 of FIG. 2.
Figure 3A:
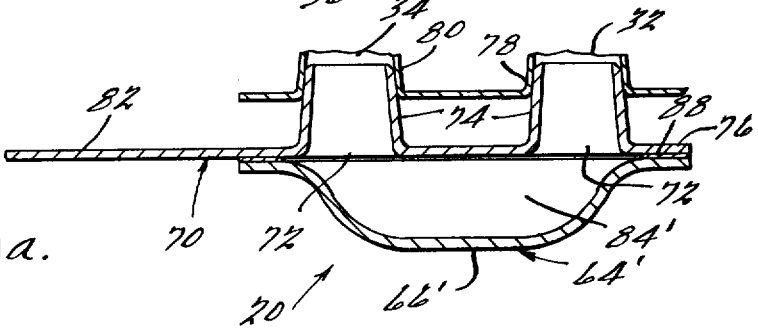
FIG. 3A is a fragmentary view of a portion of the lower end of the heat exchanger of FIG. 1 similar to that of FIG. 3 with the section also being taken along line 3—3 of FIG. 2.

As best seen with reference to FIG. 3, upper return bend assembly 18 comprises a base member 52 of a generally rectangular shape having a plurality of openings 54 extending therethrough defined by outwardly divergingly tapered tubular projections 56 extending outwardly from surface 57 thereof. Openings 54 are arranged in two rows and are spaced in such a manner as to telescopically receive respective ends 58 and 60 of fluid conduit members 30 disposed within rows 34 and 36 of heat exchanger core 16. Base member 52 also has a laterally extending planar flange portion 62 extending laterally outwardly from one side thereof which is designed to overlie inlet header 12.

A cover member 64 also of a generally rectangular shape is also provided being of a length substantially equal to base member 52 and of a width less than base member 52 and having a plurality of arcuate shaped transversely elongated embossments 66 provided thereon arranged in substantially parallel spaced relationship along the length thereof. Cover member 64 is designed to be secured to base member 52 with respective embossments 66 being positioned in overlying relationship to respective laterally adjacent openings 54. Thus, embossments 66, in cooperation with base member 52, will define a fluid passageway 68 interconnecting respective fluid conducting conduits 30 disposed in adjacent rows 34 and 36. As shown, cover member 64 has a relatively wide planar surface area surrounding each of the embossments 66 which mates with and is sealingly secured to upper surface 67 of base member 52.

Lower return bend assembly 20 is of a similar construction to upper return bend assembly 18 and comprises a base member 70 of a generally rectangular shape having a plurality of openings 72 extending therethrough defined by outwardly converging tapered tubular projections 74 extending outwardly from surface 76 thereof. Openings 72 are also arranged in two rows and are sized and spaced in such a manner as to be telescopically received in respective ends 78 and 80 of fluid conducting members 30 disposed within rows 32 and 34 of heat exchanger core 16. Base member 70 also has a laterally extending planar flange portion 82 extending outwardly from one side thereof which is designed to overlie outlet header 14. A cover member 64' is also provided which is substantially identical to cover member 64 and hence corresponding portions thereof are indicated by like numerals primed. Thus, embossments 66' of cover member 64' define fluid passageways 84' interconnecting respective fluid conducting conduits 30 disposed in adjacent rows 32 and 34.

Base members 52 and 70, as well as cover members 64 and 64', may each be easily fabricated of sheet stock in a suitable manner such as through the use of progressive dies. Thereafter, corresponding base and cover members are assembled and are preferably initially secured by a plurality of spot welds 86 so as to form separate subassemblies. Return bend assembly 18 is then preferably assembled to the core after which brazing rods may be inserted into each of the fluid conduits. Thereafter, return bend assembly 20 may be assembled to the core. The completed assembly will then be passed through a brazing oven during which brazing material 88 will flow between mutually engaging surfaces of the cover members and base members thereby creating a sealing relationship therebetween. The spot welds operate to retain the mating surfaces of the respective cover members and base members in close proximity so as to assure the brazing material will completely fill and seal the joints therebetween.

Base members 52 and 70 are also secured to side members 22 and 24 such as by welding or brazing so as to provide a framework surrounding heat exchanger core 16. Mounting channel members 26 and 28 are each secured to side members 22 and 24 and each have a pair of spaced substantially parallel outwardly extending flange portions 89, 90, 92, and 94 respectively which provide means for mounting heat exchanger 10 to equipment with which it is to be used. It should be noted however that if desired, and preferably with regard to smaller sized heat exchangers, side members 22 and 24 may be provided with flange portions similar to those provided on channel members 26 and 28 thereby eliminating these separate channel members.

While heat exchanger 10 is illustrated as having each adjacent row of fluid conducting conduits 30 connected in series so that each row conducts fluid in an opposite direction, in some cases it is desirable to provide a group of rows of fluid conducting members connected for parallel flow with respective groups being connected in series. The return bend assembly of the present invention may be easily adapted to accommodate such a design. As shown in FIG. 4, a heat exchanger core assembly 96 has four rows 98, 100, 102, and 104 of fluid conducting members interconnected by a return bend assembly 106. Return bend assembly 106 is similar in construction to either return bend assembly 18 or 20 except base member 108 has four rows of projections 110 designed to accommodate rows 98, 100, 102 and 104 of fluid conducting members and cover member 112 is provided with elongated arcuate embossments 114 of a length sufficcient to place all four laterally adjacent cconduit members in fluid communication. Thus, rows 98 and 100 may conduct fluid into the passageway defined by embossments 114 and rows 102 and 104 will conduct fluid outwardly thereof. Heat exchanger core assembly 96 is preferably of the same construction as core assembly 16 described above.

Referring now to FIGS. 5 and 6, another embodiment of a heat exchanger 116 in accordance with the present invention is illustrated and comprises inlet and outlet headers 118, 120, a core assembly 122 having rows 124, 126, 128 and 130 of fluid conducting conduit members with each laterally adjacent conduit members being connected in series by upper and lower return bend assemblies 132 and 134 respectively.

Upper return bend assembly 132 is substantially identical to both upper and lower return bend assemblies 18 and 20 described above comprising a row of embossments defining fluid passageways each having a single inlet fluid conduit member and a single outlet fluid conduit member connected thereto. However, lower return bend assembly 134 provides a double return bend arrangement and comprises a base member 136 having four rows of openings defined by outwardly extending projections 137 spaced so as to mate with respective rows 124 through 130 of fluid conducting conduit members. A cover member 138 is provided having two rows of substantially parallel spaced embossments 140, each embossment being of a length so as to provide a fluid passageway interconnecting laterally adjacent fluid conduit members disposed in rows 124, 126 and 128, 130. Thus, a single return bend assembly is provided which when secured to core assembly 122 provides a four pass counterflow heat exchanger configuration.

In each of the embodiments of FIGS. 4 through 6, base members 108, 122 and 136 are designed to be secured to side frame members so as to serve not only as part of the return bend assembly but also as a part of the heat exchanger frame assembly. In each of these embodiments, mounting means are provided on the side members of the frame assembly.

An alternative mounting arrangement is illustrated in FIG. 7 in which heat exchanger 142 is provided with a return bend assembly 144 comprising a cover member 146 having embossments 147 provided thereon which is secured to a base member 148. In this embodiment, base member 148 has a plurality of tubular projections 151 each connected in fluid conducting relationship to a conduit member 30'. Base member 148 is generally L-shaped and includes integral mounting means in the form of a flange portion 150 extending at substantially a right angle to portion 152 thereof. Flange portion 150 may be provided with suitable openings 153 so as to enable heat exchanger 142 to be secured in operative relationship to equipment for which it is designed.

Figure 8:
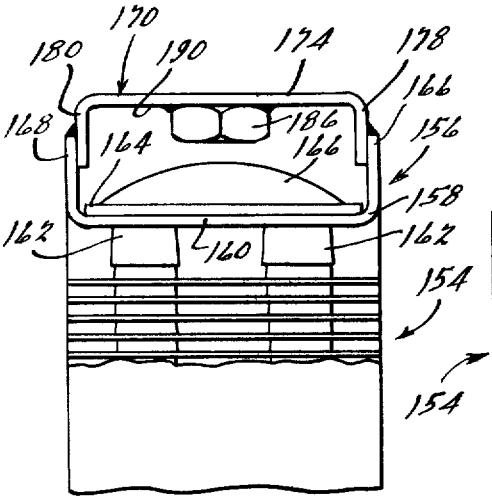
FIGS. 8 and 9 are fragmentary side and front elevational views respectively of a heat exchanger in accordance with the present invention in which mounting means are incorporated into the return bend assembly.
Figure 9:
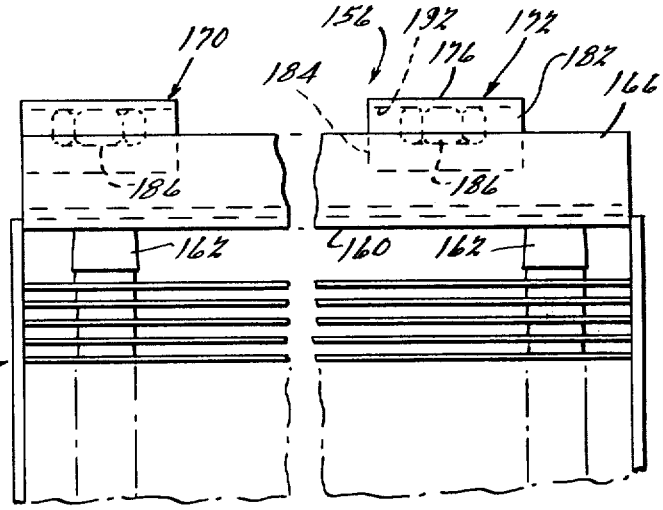

Yet another combination return bend assembly and mounting means is illustrated in FIGS. 8 and 9. In this embodiment, heat exchanger core 154 has a return bend assembly 156 provided thereon comprising a base member 158 having a central portion 160 provided with outwardly extending tubular projections 162 similar to those described above and a cover member 164 having appropriately positioned embossments 166 provided thereon which is secured to portion 160 thereof. Cover member 164 is substantially identical to cover member 66 described above. However, in this embodiment, base member 158 is generally U-shaped having a pair of substantially parallel longitudinally extending spaced opposed flange portions 166 and 168 integrally formed thereon. A pair of generally U-shaped members 170, 172 each having a central portion 174, 176 respectively and a pair of substantially parallel spaced leg portions 178, 180 and 182, 184 respectively extend between and are secured in spaced apart relationship to flange portions 166 and 168. Central portions 174 and 176 each have an opening extending therethrough and a nut 186 secured to the respective inner surfaces 190, 192 thereof. Nuts 186 are designed to receive a threaded fastener extending through suitable frame members provided on the equipment to which the heat exchanger is to be mounted. Thus, return bend assembly 156 also provides mounting means integral therewith.

Figure 10:
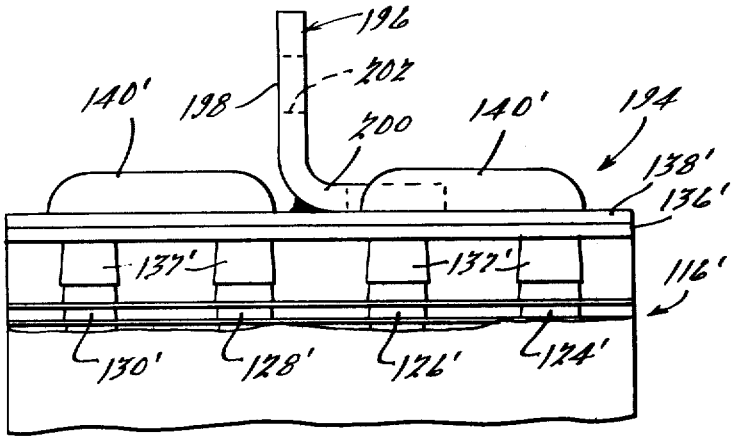
FIG. 10 is a fragmentary side elevational view of another embodiment of the present invention.
Figure 11:
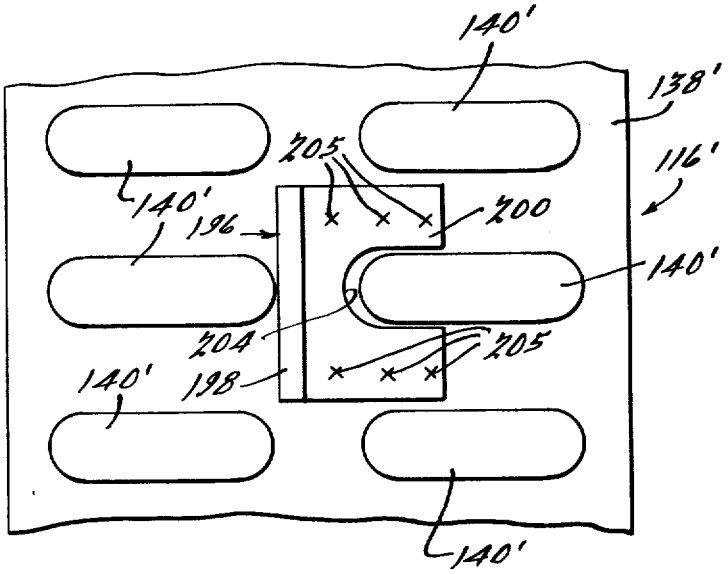
FIG. 11 is a fragmentary plan view of the embodiment of FIG. 10.

Yet another embodiment of a return bend assembly including mounting means is illustrated in FIGS. 10 and 11 in which a return bend assembly 194, which is substantially identical to return bend assembly 134, is illustrated and accordingly has portions corresponding to portions of return bend assembly 134 indicated by like numerals primed. However, as shown therein, base member 136' is provided with outwardly diverging tapered tubular projections 137' as opposed to the outwardly converging tapered tubular projections 137 provided on base member 136. In this embodiment a generally L-shaped mounting bracket 196 is secured directly to cover member 138' in any suitable manner such as by welding or the like. Mounting bracket 196 has a pair of leg portions 198 and 200 disposed at generally right angles with upstanding leg portion 198 having a suitable opening 202 therein for accommodating a bolt or the like. Leg portion 200 has a generally U-shaped notch 204 provided therein so as to enable it to partially surround an embossment 140' provided on cover member 138'. Preferably, a plurality of such brackets will be secured to cover member 138' so as to enable heat exchanger 116' to be firmly secured to the operating equipment for which it is designed.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. In a heat exchanger of the type comprising a heat exchanging core assembly having a plurality of fluid conducting conduit members surrounded by heat radiating fins, an inlet header connected to one end of each of a first group of said conduit members, an outlet header connected to one end of each of a second group of said conduit members and means interconnecting the other ends of said first group of conduit members with the other ends of said second group of conduit members, the improvement wherein said interconnecting means comprises:

a base member overlying end portions of said conduit members, said base member having a plurality of openings defined by tapered tubular projections extending outwardly on one side of said base member, each of said projections being secured in fluid conducting telescopic relationship with one of said other ends of said fluid conduit members, said projections each having a taper which prevents telescopic movement of said one of said other ends beyond a plane defined by said base member;

an elongated cover member having a plurality of transversely extending raised spaced embossments, each of said raised embossments being positioned so as to overlie and extend between at least first and second ones of said plurality of openings whereby said raised portion and said base member define a fluid passageway interconnecting said one of said other ends of said first group with said one of said other ends of said second group of fluid conduit members;

a plurality of spot welds spaced between and adjacent opposite ends of said embossments for retaining said cover member directly to another side of said base member at a plurality of spaced locations intermediate each of said plurality of embossments; and sealing means further securing said base member and said cover member subsequent to application of said spot welds, said sealing means also securing each of said one of said other ends within respective of said tubular projections whereby said sealing means may operate to create a substantially fluid tight sealing relationship therebetween.

2. A heat exchanger as set forth in claim 1 wherein said first group of conduit members comprises a first row and said second group of conduit members comprises a second row of conduit members disposed in spaced parallel relationship to said first row and said embossments extend transversely of said cover member in spaced substantially parallel relationship.

3. A heat exchanger as set forth in claim 2 wherein said base member has a length greater than said cover member and said heat exchanger includes side frame members secured to opposite end portions of said base member, said side frame members extending in parallel relationship to said conduit members.

4. A heat exchanger as set forth in claim 1 wherein said embossment is elongated and has a length substantially equal to the sum of the diameters of said first and second ones of said conduit members and the distance between said first and second ones of said conduit members.

5. A heat exchanger as set forth in claim 1 wherein each of said embossments overlies and interconnects a multiple pair of adjacent fluid conducting members.

6. A heat exchanger as set forth in claim 5 wherein said multiple pairs of fluid conducting members are laterally disposed in said heat exchanger core.

* * * * *